US007314217B1

(12) United States Patent
Dick

(10) Patent No.: US 7,314,217 B1
(45) Date of Patent: Jan. 1, 2008

(54) PRESIDENTIAL ELECTION GAME

(76) Inventor: William S. Dick, 37 W. Main St., Suite 210, Waynesboro, PA (US) 17268

( * ) Notice: Subject to any disclaimer, the term of this patent is extended or adjusted under 35 U.S.C. 154(b) by 81 days.

(21) Appl. No.: 11/226,627

(22) Filed: Sep. 14, 2005

Related U.S. Application Data

(60) Provisional application No. 60/610,347, filed on Sep. 16, 2004.

(51) Int. Cl.
*A63F 3/00* (2006.01)

(52) U.S. Cl. ..... 273/257; 273/243

(58) Field of Classification Search ..... 273/243, 273/257

See application file for complete search history.

(56) References Cited

U.S. PATENT DOCUMENTS 4,118,036 A * 10/1978 Marse ..... 273/257

* cited by examiner

*Primary Examiner*—Vishu K. Mendiratta
(74) *Attorney, Agent, or Firm*—Neil F. Markva

(57) ABSTRACT

A political campaign game board has a play surface including a map of the United States with each state having indicia indicating the number of electoral votes assigned to each state, a plurality of spaces forming a play path that surrounds the map, a location for campaign headquarters, and a location for a campaign workers pool. The play path includes a plurality of non-state spaces and 50 state spaces each including the name of each state and the number of electoral votes assigned to each state. Distinct play markers, which represent a respective player's candidate to be moved along the play path spaces. Campaign office devices associated with each distinct play marker correspond to campaign offices to be placed on the map during play. Shaped campaign worker elements may be removably attached to each campaign office device wherein each element represents a campaign worker during play. Campaign headquarter cards, dice, and money are included for play.

20 Claims, 6 Drawing Sheets

*Electoral Vote Tally*

| *State* | *Electoral Votes* | *Total Votes* | *State* | *Electoral Votes* | *Total Votes* |
|---|---|---|---|---|---|
| | | | | | |
| | | | | | |
| | | | | | |
| | | | | | |
| | | | | | |
| | | | | | |
| | | | | | |
| | | | | | |
| | | | | | |
| | | | | | |
| | | | | | |
| | | | | | |
| | | | | | |
| | | | | | |
| | | | | | |
| | | | | | |

| | | | | | | | | | | | |
|---|---|---|---|---|---|---|---|---|---|---|---|
| | | | | | | | | | | | |

*Fig. 7*

PRESIDENTIAL ELECTION GAME

RELATED APPLICATION

This is a non-provisional application for which priority is claimed in Provisional Application No. 60/610,347 filed Sep. 16, 2004.

BACKGROUND OF THE INVENTION

1. Field of the Invention

This invention relates to a presidential election game. More particularly, the invention relates to American politics and enables the players thereof to compete for the Presidency of the United States of America through involvement in a presidential political campaign.

2. Background Description

The Presidency of the United States of America is a democratically elected position which is won by an eligible candidate who successfully competes in a quadrennial national election. Generally, each of the existing political parties endorses and sponsors a presidential candidate at partisan caucuses or primary elections held prior to the election. Although a majority of the American voting public typically votes for a candidate from one of the major political parties, additional candidates may be endorsed and/or sponsored by one or more minor political parties.

According to the presidential election process, a candidate must accumulate a majority of the electoral college votes to be elected to the Office of the President. The only other elective federal official not elected by direct, i.e., popular, vote is the Office of the Vice President. Every fourth year, each state chooses as many electors to the Electoral College as it has senators and representatives in Congress. The founding fathers chose to elect the President of the United States through the Electoral College where each state is allotted its electoral votes according to its population. The Electoral College thus equalizes the power of the vote from state to state. Otherwise, the most populous states would automatically control the elections of the Presidents.

Each state is allocated a number of electors equal to the number of its U.S. Senators (always two (2)) plus the number of its members in the U.S. House of Representatives (which may change each decade according to the size of each State's population as determined in the census). The more populous a state is, then the more electoral votes it has. There are 100 senators and 435 representatives, which when added to the three electors representing the District of Columbia as provided by the 23rd Amendment to the Constitution, totals 538 members of the Electoral College. Of this number, 270 electoral votes, i.e., a majority vote, are needed to elect the president and vice-president.

The voting decisions of the electors may be based on the outcome or trend of a popular vote that is tallied in each state. However, the outcome of the electoral college vote may not necessarily reflect the outcome of the popular vote of the entire nation that includes all of those votes tallied and reported by each state. Moreover, reporting of the near-final popular vote generally occurs during the evening hours of Election Day with that reporting generally being chronologically staggered from the eastern part of the country to the western part of the country.

It is a common misunderstanding that a majority popular vote for a particular candidate determines the ultimate outcome of the election, when in fact, it is the final electoral college vote that actually determines the successful candidate who may be different from the candidate who won the popular vote. Also, both the popular vote and the electoral college vote may be swayed by changes in voting patterns based on news media-generated projections and predictions as individual state popular votes are tallied and reported to the public prior to the time the polls are closed.

U.S. Pat. Nos. 4,118,036; 4,299,390; 4,709,926; 5,624,120; and 5,660,390 disclose examples of presidential board games where the players vie for electoral votes to be elected or win the game. None of these games include campaign workers, a campaign headquarters, and a campaign workers pool that come and go with the manipulation of dice and the drawing of cards.

THE PURPOSE OF THE INVENTION

The first player to control 270 electoral votes is elected President and wins the game. Each player will try to control as many states as possible by opening a campaign office in these states and completing the team of campaign workers in these states. A player gains control of a state by being the first player to complete a team of campaign workers in that state. That player adds the number of electoral votes for that state to his or her total of votes. There are many ways to gain entry into any state. Strategy and luck will determine which player eventually controls each state.

SUMMARY OF THE INVENTION

The invention is directed to a political campaign game that comprises a game board having a plurality of sides and defines a play surface including a map of the United States with first indicia disposed on the outline of each state indicating the number of electoral votes assigned to each state. As is evident in the drawings and the written description of the invention, a plurality of spaces that forms a single common play path for the players that surrounds the map, a location for campaign headquarters, and a location for a campaign workers pool. The play path includes 50 state spaces and a plurality of non-state spaces with the state spaces each having second indicia disposed thereon indicating the name of each state and the number of electoral votes assigned to each state. A first plurality of distinct play markers to be selected and used by each player represent a respective player's candidate to be moved along the play path spaces. A set of a second plurality of campaign office devices associated with each distinct play marker corresponds to campaign offices to be placed on the map during play. A set of a third plurality of shaped campaign worker elements is for removable attachment to each campaign office device wherein each element represents a campaign worker during play. A set of campaign headquarter cards is for placement on the campaign headquarters location with each card having instructions printed thereon, and each player has control of the set of a plurality of shaped campaign worker elements for placement in the campaign workers pool location. Chance means are provided for randomly determining the number of spaces a play marker may be moved along the play path during a player's turn. Play money is distributed to each player who places a distinct candidate play marker on the space designated White House and one shaped campaign worker element is placed in the campaign workers pool location to begin play.

More specifically, the first plurality of candidate play markers are distinguished by different selected colors to be used by each player to move along said spaces in said play path. The set of a second plurality of campaign office devices are distinguished by the different selected colors associated with each distinct colored play marker. The campaign office devices each has a base member with an upwardly directed spindle disposed thereon. The set of a third plurality of shaped campaign worker elements are distinguished by the different selected colors associated with each distinct colored play marker. The campaign office devices each has a base member with an upwardly directed spindle disposed thereon, and each campaign worker element is star-shaped and has a bore that is effective to fit each element over the spindle which extends upwardly for a distance sufficient to hold a plurality of campaign worker elements of the same distinctive color as the same color play marker to represent campaign workers in a campaign office.

In a specific embodiment, the spindle of each campaign office device extends upwardly from the base member for a distance sufficient to hold three shaped campaign worker elements to represent a complete campaign team that signifies control of a state on which a campaign office device rests during play. There are six sets of spindles of corresponding colors with twenty-seven (27) spindles in each set. There are six sets of shaped elements or pieces that have holes for each shaped piece to be placed on each spindle. The map includes five different colors each associated with a plurality of states within a designated group of electoral votes; namely, red for states having 21 to 55 electoral votes; blue states having 12 to 20 electoral votes; green states having 9 to 11 electoral votes; orange states having 5 to 8 electoral votes; and yellow states having 3 to 4 electoral votes. The chance means includes a set of three standard dice each being a different color. A set of five caution flags having any desired size and shape that are used to designate protected states and to accomplish the desired results of play. A set of score sheets is provided for each player to keep account of each player's electoral vote total during play. The play path includes at least 60 spaces for movement of each player's play markers, and the plurality of non-state spaces includes a first group of spaces containing indicia indicating that the president backs a player, a second group of spaces containing indicia indicating a player is to take orders from campaign headquarters, a space designated White House, a space designated Air Force 1, and a space designated Spin Zone.

The map of the United States in the specific embodiment includes five (5) groups of states designated by a different color as follows: CA, TX, NY, FL, PA, IL having 21 to 55 electoral votes; MA, VA, NJ, NC, GA, MI, OH having 12 to 20 electoral votes, LA, AL, CO, MD, AZ, WI, MN, IN, MO, TN, WA having 9 to 11 electoral votes; WV, NB, NM, UT, NV, MS, AR, KS, CT, IA, OK, OR, SC, KY having 5 to 10 electoral votes; and DE, DC, VT, AK, HI, ME, NH, RI, ID, MT, WY, ND, SD having 3 to 4 electoral votes. The chance means includes a set of three standard dice, and before play starts, each player selects a home state by rolling all three (3) dice with the following rolls allowing the choice that will be the starting base for that player's campaign according to the following groups of states: a roll of 3 or 18—a home state selected from the 6 states having 21 to 55 electoral votes; a roll of 4 or 17—a home state selected from the 7 states having 12 to 20 electoral votes; a roll of 5 or 16—a home state selected from the 11 states having 9 to 11 electoral votes; a roll of 6, 7, 14, or 15—a home state selected from the 14 states having 5 to 10 electoral votes; and a roll of 8, 9, 10, 11, 12, or 13—a home state selected from the 13 states having 3 to 4 electoral votes. Upon choosing a home state, each player places a campaign office device with a preselected number of campaign worker elements (three (3) in this embodiment) attached thereto to represent a complete campaign team and to signify control of that state while recording the number of electoral votes assigned to the state on the player's score sheet.

To prepare for playing the political campaign game of the invention, the chance means includes a set of three (3) standard dice, and each player selects a home state by rolling all three (3) dice to choose a home state on which the player places a campaign office device with a preselected number of removably attached campaign worker elements thereto (three (3) in this specific embodiment) to represent a complete campaign team and to signify control of the player's respective home state. The campaign office device with the three (3) removably attached campaign worker elements have the same corresponding color as their respective player marker that each player places on the White House space to start play. Each player also places a campaign worker element in the campaign workers pool. One player is chosen as treasurer, and from the treasury the treasurer gives each player four (4) $50,000 amounts, three (3) $100,000 amounts, and one (1) $500,000 amount to equal a total of $1,000,000 to pay for opening campaign offices and for obtaining campaign workers in the offices during play. Each player receives $250,000 each of the first two times a candidate play marker passes the White House space, and a player having the most electoral votes at the time the player's candidate passes the White House space, that player will receive a bonus of $100,000 for a total of $350,000.

During play of the political campaign game of the invention, each time a player's respective play marker passes the White House space while moving clockwise along the play path, the player may put a campaign worker in the campaign workers pool. The campaign office devices each has a base member with an upwardly directed spindle disposed thereon and each player places a campaign office device with three (3) star-shaped campaign worker elements attached thereto to represent a complete campaign team of a campaign director, a campaign treasurer, and a media events coordinator placed in a home state to signify control of the respective player's home state. As play continues, the first player to complete a team in any state by having a state campaign office and the three (3) campaign worker elements immediately removes all of the other player's campaign teams in that state. If a candidate lands on a state that is controlled by an opposing player, the candidate must pay $50,000 to the treasury and the player who controls the state gets the option to open a state campaign office or place a campaign worker in an opened office in any non-controlled state or the player who controls the state may use the free campaign worker in a debate as discussed below. If a player's candidate play marker lands on a state controlled by that player, then that player has the option to do nothing, buy worker(s), or buy protection for the player's controlled state.

BRIEF DESCRIPTION OF DRAWINGS

The above-mentioned features, aspects, and advantages of the present invention will be better understood from the following detailed description of a specific embodiment of the invention in conjunction with the drawing, in which:

FIG. 7 is a plan view of a score sheet used with the game board of the invention.

DESCRIPTION OF SPECIFIC EMBODIMENT

Figure 1:
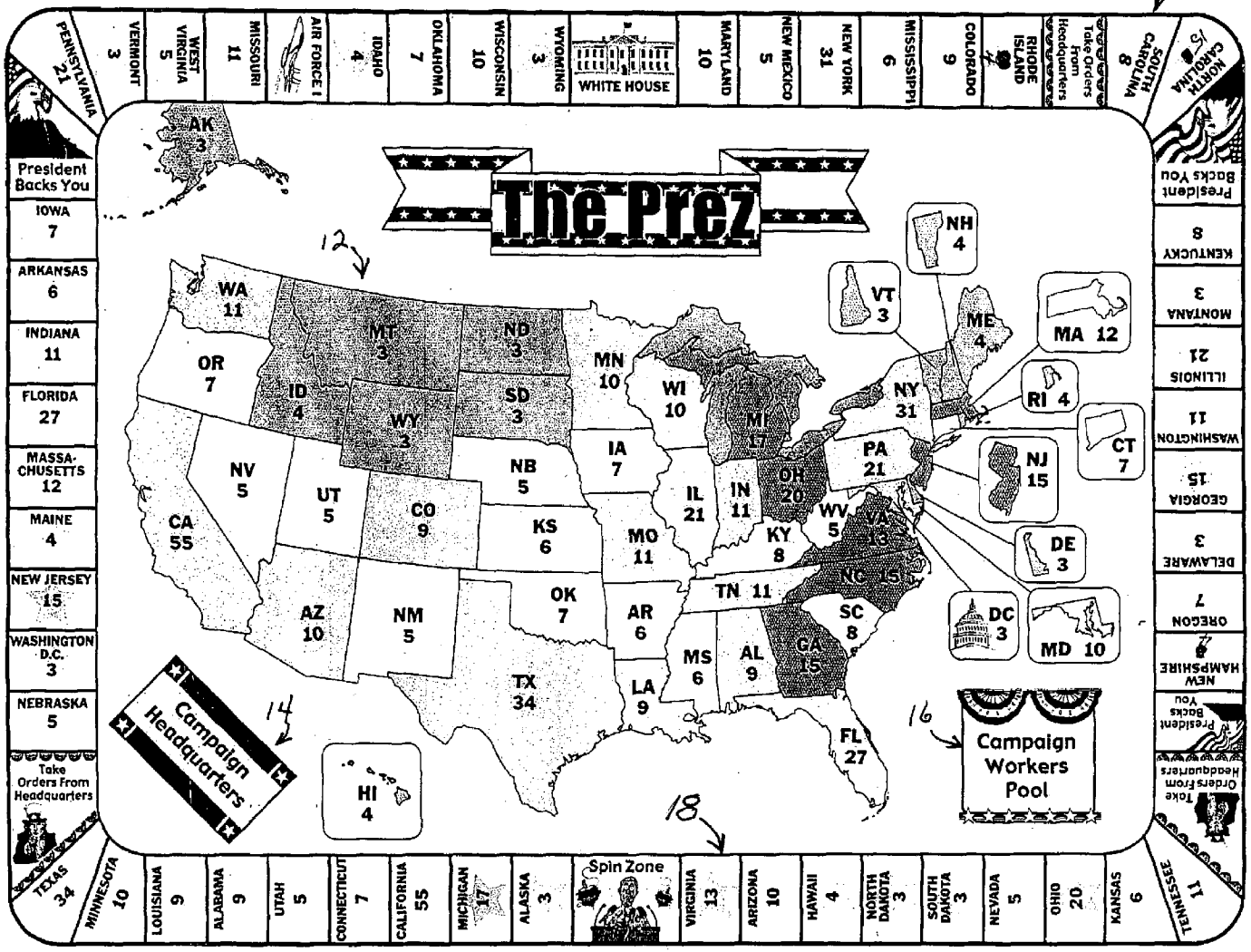
FIG. 1 is a top plan view of the game board of the invention.
Figure 4:
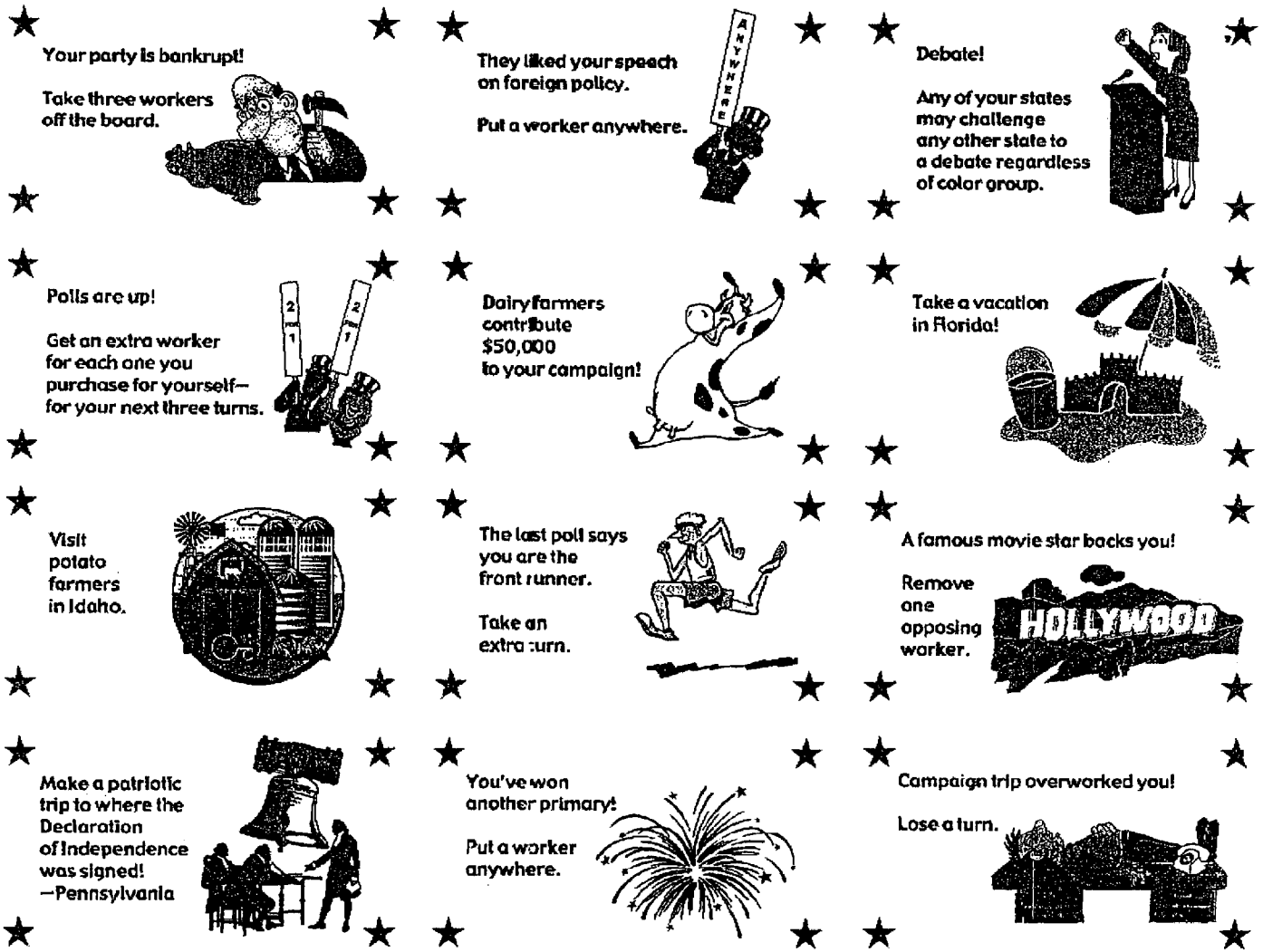
FIGS. 4, 5, and 6 are views of the face of thirty-four (34) campaign headquarters cards of the invention each shown with a star at each corner thereof.
Figure 5:
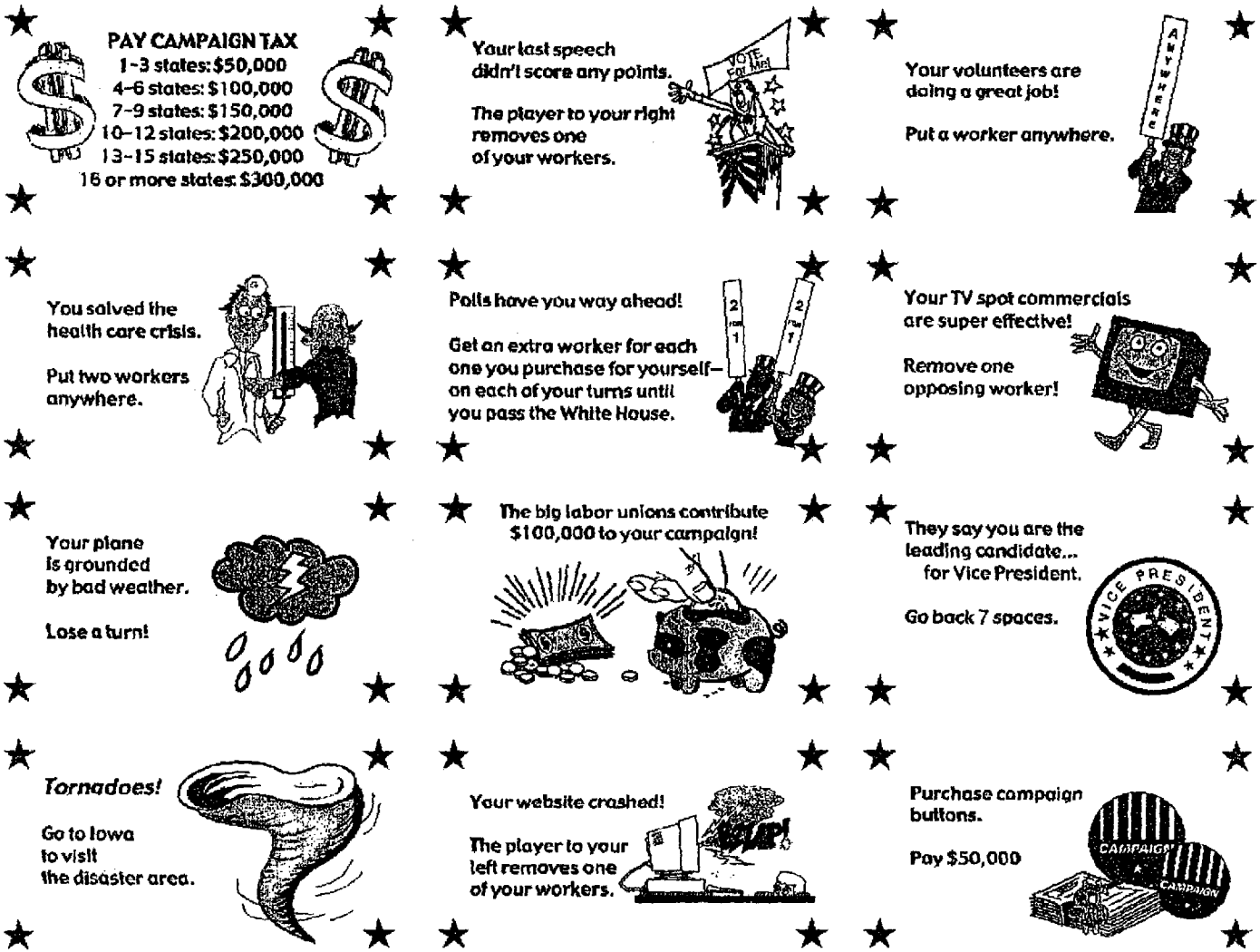
Figure 6:
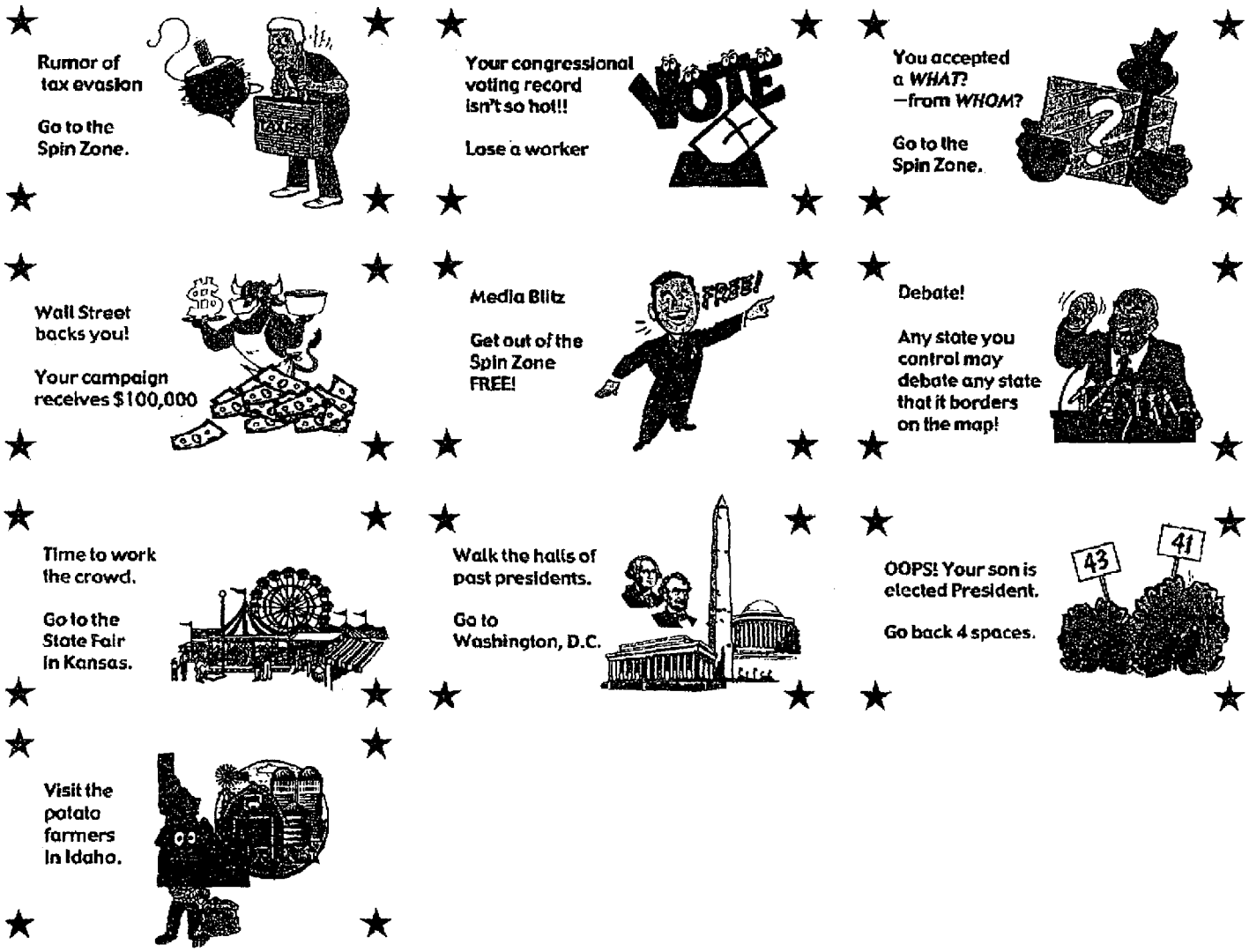

The game board, generally designated 10, as shown in FIG. 1 has a map of the United States, generally designated 12, in the center with sixty spaces defining a playing path of movement, generally designated 18, along the outside of the board 10. This embodiment allows up to six (6) players each with a different colored marker that represents the player's candidate to be moved along the path of movement. The marker can be any shape and a size sufficient to fit into each space as it moves along the playing path. Additional equipment for the games comprises:

1. Money.
2. Six sets of towers or spindles of corresponding colors with twenty-seven (27) towers in each set with each tower representing a state campaign office that has a base with an upwardly directed spindle shape that will be placed on the map during play.
3. Six sets of shaped pieces such as stars of corresponding colors that have holes for each shaped piece to be placed on each tower or spindle with each star shaped piece representing a campaign worker who will be placed in the campaign office.
4. A set of cards marked "Campaign Headquarters." (See FIGS. 4, 5, and 6.)
5. A set of score sheets for each player to keep tabs on his or her vote total.
6. A set of three standard dice—one red, one white, and one blue.
7. A set of five orange caution flags that will designate protected states.

The score sheets as shown in FIG. 7 may take any desired form to record the electoral vote tally for the player as they are acquired, and the caution flags are not shown but may be any desired size and shape to accomplish the desired results of play.

PREPARATION FOR PLAY: To prepare for play, place the board 10 on a table or some flat surface. Each player chooses a candidate (a colored marker), and a corresponding set of campaign offices (towers or spindles 11) and workers (such as star-shaped pieces 13 that fit on the towers) of the same color. One player is chosen as treasurer, and from the treasury gives each player $1,000,000, divided as follows: four $50,000 amounts; three $100,000 amounts; and one $500,000 amount. The Campaign Headquarters cards are shuffled and placed on the appropriate space on the board. All players place their candidates on the White House and each player puts one campaign worker in the space marked "Campaign Workers Pool."

Figure 2:
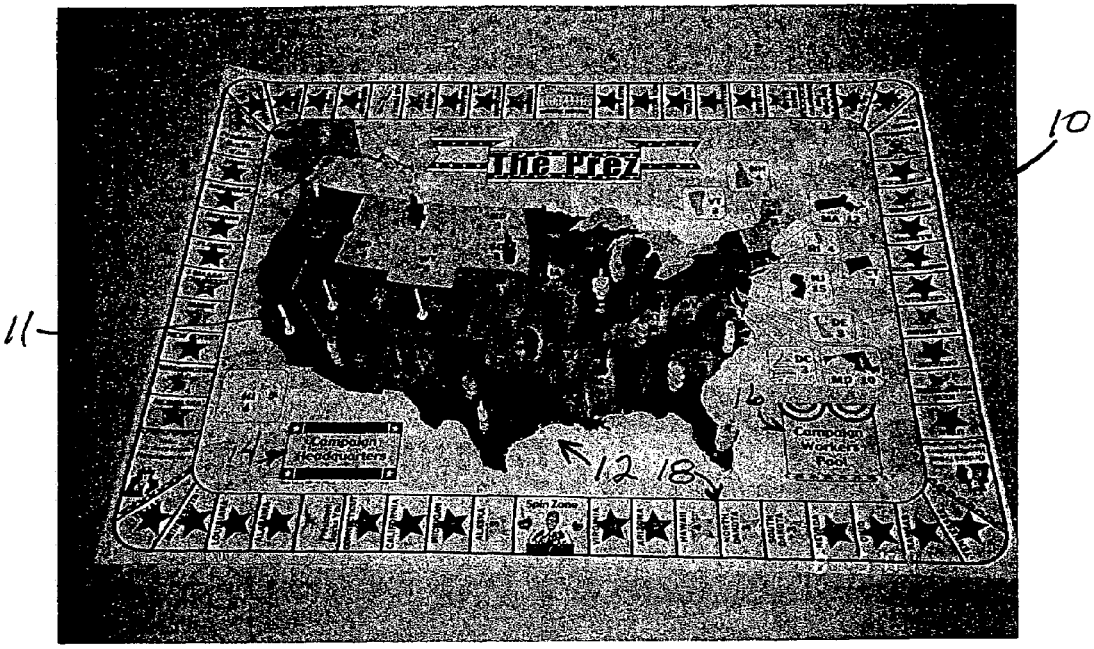
FIG. 2 is a perspective view of the game board of FIG. 1 with campaign offices (spindles or towers) with and without campaign workers (pieces with holes that fit over the spindles or towers) distributed across the board in various states.
Figure 3:
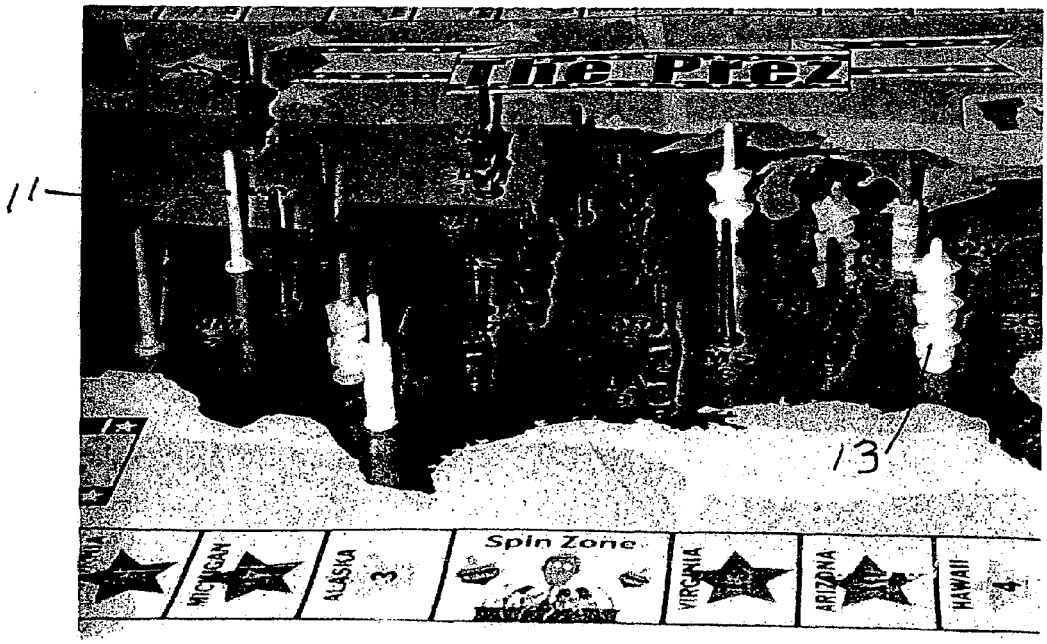
FIG. 3 is another perspective close-up view of the game board of FIG. 1 with campaign offices (spindles or towers) with and without campaign workers (pieces with holes that fit over the spindles or towers) distributed across the board in various states.

CHOICE OF HOME STATE: Before play starts, each player must select a home state that will be the starting base for that player's campaign. Each player, in no particular order, rolls all three dice and the following rolls allow the choice of the following states:

3 or 18—a red home state—6 states having 21 to 55 electoral votes 4 or 17—a blue home state—7 states having 12 to 20 electoral votes 5 or 16—a green home state—11 states having 9 to 11 electoral votes 6, 7, 14, or 15—an orange home state—14 states having 5 to 8 electoral votes 8, 9, 10, 11, 12, or 13—a yellow home state—13 states having 3 to 4 electoral votes COMPLETE CAMPAIGN TEAM: Upon choosing a home state, a player (a) places a colored campaign headquarters office (a tower comprising a spindle upwardly directed from a base) in that state on the map 12 in the center of the board 10, and (b) stacks three campaign workers (star-shaped pieces 13) on the spindle 11 as shown in FIGS. 2 and 3. This is a complete campaign team and signifies "control" of that state. Tabulate your score on your score sheet by adding the number of electoral votes assigned to that state.

The player with the lowest starting electoral vote total begins play by rolling all three dice. If there is a tie for low vote total, those players who are tied roll to see who goes first with the lowest roll going first. A turn is completed when the player passes the dice to the player to the left and play continues to the left. The game is now ready to start.

DICE: All three dice are rolled for a player's turn. No certain color die is more important than another. If triples (all three dice the same) are rolled, the player takes the turn as usual and when the turn is complete, chooses a Campaign Headquarters card (each card is shown with a star on each of its corners in FIGS. 4, 5, and 6). The player must follow the directions of the card even if the player's candidate had landed on the Spin Zone space. Finally, after completing the actions directed by the card, the player receives a campaign worker, at no charge, that may be placed in any campaign office the player has opened on the board. A player does not get a second turn for triples.

MOVEMENT OF THE CANDIDATES: Starting at the White House and moving clockwise, a player moves his or her candidate on the playing path 18 of spaces around the outside of the board. All three dice are rolled to determine the number of spaces to move. A space designation governs the player's actions as follows:

If a candidate lands on a non-state space see SPECIAL SPACES below.

If a candidate lands on a space designated as a state, look at the map 12 to see if the state is controlled by any player. If it is, see CONTROL OF STATES below.

If a candidate lands on a space designated as a state and that state is not controlled by any other player, that player may kick off the campaign in that state by paying $50,000 to the treasury and placing a state campaign office (a tower 11) of the corresponding color on that state on map 12.

If the player has already opened a campaign office in that state, then the player may choose to pay $50,000 to the treasury, and place one campaign worker (a star-shaped piece 13 on a tower) in the state. Workers are represented by the coordinated color stars. You can't tell them apart, but the three (3) pieces 13 represent a campaign director, a campaign treasurer, and a media events coordinator to complete the team. The first player to complete the team by having an office and all three campaign workers in the state will control the state. After the team is complete, no other workers are placed in the state unless there is a debate (See DEBATING below). A player always has the right to begin or build a campaign team in the state on which the candidate lands UNLESS the state is controlled by another player who has a completed campaign team in that state.

EXAMPLE: The RED candidate lands on Florida. If Florida has no completed campaign team in it, upon paying $50,000, RED may put a red campaign office there. If Florida has a red campaign office already opened there, upon paying $50,000, RED may put one campaign worker there. Even if there is a blue campaign office and a green campaign office already in that state, and even if there are workers in those offices, upon paying $50,000, RED may begin, or build upon, its campaign there. In this manner, a player builds up a campaign team on each state. A player may at any time refuse the option to place an office or a campaign worker on a non-controlled state where the player's candidate has landed and play continues to the next player.

CAMPAIGN WORKERS POOL: At the start of the game, each player starts play with one star (a campaign worker) 13 in "Campaign Workers Pool" 16. On any player's turn where that player is allowed to open a state campaign office or chooses to place a campaign worker in a state campaign office that had previously been opened in a state, the player may remove the campaign worker from Campaign Workers Pool 16 and add that campaign worker to that state on that turn. This is a free campaign worker. In this manner a player may be half way to control of a state on one turn. This option may only be used once each time around the play path 18 and, if not used, is lost.

At the moment the player's candidate passes the White House, the player may again put a campaign worker in Campaign Workers Pool 16. At no time may a player have more than one campaign worker in the Campaign Workers Pool. The new campaign worker may be used on the turn that the player passes the White House.

In other words, if the player begins the turn with no worker in the Campaign Workers Pool, then rolls the dice, and the player's candidate lands on New York, passing the White House on that turn, the player may replenish the Campaign Workers Pool with a new campaign worker and immediately use it for a second campaign worker in New York as long as the player has chosen to pay $50,000 to open a state campaign office or place another campaign worker there.

The campaign worker from the Campaign Workers Pool is not free to be placed anywhere. It accompanies placement of an office or worker in a state, even if workers are being placed in a state for debate. It may only be used on a player's actual turn, not when a player has received a free worker on some other player's turn. This option is only available once each time around the board. So it must be used wisely.

CONTROL OF STATES: The first player to complete a team in any state by having a state campaign office and three (3) stars (the campaign director, the campaign treasurer, and the media events coordinator) immediately removes all of the other player's campaign teams in that state. The player should now mark the number of electoral votes for that state on his or her score sheet to tabulate that player's total electoral votes. No other campaign teams may be placed in a state with a completed team in it. Also, only a completed team may arrange a debate. (See DEBATING below.)

If your candidate lands on a state that is controlled by an opposing player, you must pay $50,000 to the treasury and the player who controls the state gets the option to open a state campaign office or place a campaign worker in an opened office in any non-controlled state (even on states where that candidate has never landed), or the player who controls the state may use the free campaign worker in a debate. (Again, see DEBATING below.)

If your candidate lands on a state that you control, then you have several options: do nothing; buy worker(s); or buy Protection for that state.

BUYING PROTECTION: For $200,000, you may buy Protection for that state on which your candidate has landed. Place an orange caution flag in that state to show that it is protected. Now no other player may remove control by landing on the White House or by debating that state. The state remains in play as usual. If the player who controls that state chooses to do so, that state may be used for debating. However, if the debate, which could only be started by the player who controls that state, leads to loss of control of the state, then the protection is removed.

STATE COLOR GROUPING: The color groups into which the states are divided come into play if the candidate lands on a state that the player already controls. If that state is a yellow-group state, an orange-group state or a green-group state, the player may pay $50,000 and get one campaign office or worker to put on any non-controlled state, or to use in a debate as noted above. If the state is a large blue-group state, the player may pay $50,000 each and get up to two campaign offices or workers to put on any non-controlled state or to use in a debate as noted above. If the state is one of the largest red-group states, the player may pay $50,000 each and get up to three campaign offices or workers to put on any non-controlled state or to use in a debate as noted above.

DEBATING: Any time a player with control of a state gets one or more campaign workers to "put anywhere" by way of purchase, a campaign headquarters card, and the like, that player (the challenger) may challenge any other player who controls a state in the same color-group to a debate. The challenger adds the one or more campaign worker(s) to the campaign team on the challenger's state. The worker from the Campaign Workers Pool may also be added to this group of workers helping with the debate. First, the challengee then calls a die—"Red," "White," or "Blue." Then, the challenger rolls all the dice.

- If one of the challenger's two dice is higher than the challengee's die, one campaign worker is removed from the challengee's state.
- If the die which the challengee called is equal to or higher than the higher of the challenger's two dice, one campaign worker is removed from the challenger's state.
- If the die which the challenges chose is higher than the total of both of the other two dice, two campaign workers are removed from the challenger's state.

The campaign office is treated in the same manner as a campaign worker so the office may be removed as well after all workers are removed. A debate must have at least three rolls of the dice. The challengee may choose a new color die before each roll. This process is repeated until the challenger chooses to stop, which the challenger may choose to do at any point after the first three rolls. At that time, the original campaign workers or offices that remain on the states are left there and play continues as if those workers had been placed there in normal play. (Note, however, it is now possible that one or both of the two states are no longer "controlled" and other players may enter to build campaign teams.)

If the challenger's state still has "extra" campaign workers (more than a campaign office and three workers), control is maintained and the extra workers are removed and not used elsewhere. However, in the case where the challenger has had a very successful debate and forced the removal of all campaign workers and the campaign office from the challengee's state (through four successful rolls of the dice), the challenger may move any extra campaign workers left on the challenger's state into the challengee's state. In that event, the first such worker is converted to a campaign office.

If the challenger has lost all of the campaign workers thus leaving only a campaign office, and yet continues to roll the dice and takes a double loss (by the challengee's die being greater than the sum of the challenger's dice), the campaign office is removed and the challengee gets to open a free campaign office in that state to replace it. A challenger must stop if all the campaign workers and the campaign office in the challenger's state have been lost. Unless allowed by a Campaign Headquarters card, no player may debate another player outside the color-group where a state is controlled.

Special Spaces

White House: To live in the White House is a player's utmost goal. So this should be the most important space on the board. The players' candidates start here. If the player qualifies, each time that player's candidate passes the White House he or she may collect federal campaign funds from the Treasury. In addition to the possible receipt of campaign funds, each player has the right to replace the campaign worker in the Campaign Workers Pool for future use during the next round.

When a player passes the White House for a second time in the game, that player may take control of a second state (the player's running mate's state). Any yellow group state that has no activity may be chosen. If there are no yellow group states with "no" activity, then an orange group state may be chosen. The player takes control of this state by placing a campaign headquarters and three stars on the chosen state and adding the respective electoral votes to his or her score sheet.

If a candidate lands directly on the White House, the player chooses one of four options:

1. Receive $500,000.
2. Receive two (2) free campaign workers that may be placed anywhere on the board or used in a debate.
3. Completely remove one opposing campaign team (as long as it is not protected) from any color-group in which that opposing player also controls a state.
4. Remove "protection" (orange caution flag) from one opposing campaign team from any color-group in which that player also controls a state upon the payment of $300,000 to that opposing player.

The player who has landed on the White House does not then collect campaign funds for passing it on the next turn. An "O" should be marked in the first box in the line of boxes at the bottom of the score sheet. Since that player has not yet "passed" the White House, no campaign worker goes into the Campaign Worker Pool till the next turn.

Air Force One: You get to ride in the President's airplane. If a player's candidate lands on this space, that player may move the candidate to any space on the board except the White House. The player does not pass the White House or collect any campaign funds, but moves directly to any other space as if the candidate had landed there. HINT: This can be an extremely powerful turn if the player moves the candidate to the space of a red-group state that the moving player controls and then purchases three (3) campaign workers to be placed anywhere or used in debate.

Spin Zone: If a player's candidate lands on this space or is sent here by a Campaign Headquarters card, that player may lose up to his or her next three turns. To get out of the media spotlight, a player may pay $150,000 to the Treasury for a media blitz to put the proper spin on the publicity and move on the next turn as usual. Or the player may elect to lose the next turn and pay $100,000 for a lesser media blitz before the following turn and move as usual. Or the player may choose to lose two turns and pay $50,000 for a small media blitz before the third turn and move as usual. Finally, the player may choose to lose three turns and move on the fourth turn without paying anything.

President Backs You: If a player lands here, the player must roll all three dice to determine if such backing is beneficial. If the total of the dice is 10 or above, the player gets one free campaign worker to place anywhere. If the total is less than 10, the player must remove a campaign worker from any state. HINT: Always try to have some campaign workers available late in the game. You don't want to be forced to lose control of a state by having to remove a worker from a controlled state!

Campaign Headquarters If a player's candidate lands here, the player must take a Campaign Headquarters card and follows its directions. All cards are returned to the bottom of the pile except the Free Media Blitz cards that are held by a player until used. Campaign Headquarters cards are also drawn when a player rolls "triples." "Double all you do" cards only provide for the doubling of a player's campaign workers obtained on that player's next turn or turns. It does not double other players' campaign workers purchased by that player nor does it "double" the free worker from the Campaign Workers Pool. A card which allows you to remove an opponent's worker does not allow you to take a worker from a completed team which controls a state.

MONEY: Money is absolutely essential in a Presidential campaign. Each of the first two times a candidate passes the White House, the player receives $250,000. If a player has the most electoral votes (also called "the leader") at the time the player's candidate passes the White House, that player (or leader) will receive a bonus of $100,000 for a total of $350,000. (This leadership can change from turn to turn. So several candidates may be eligible to receive the extra $100,000 on one turn following another.)

After the first two rounds, a player must qualify as a viable candidate. Use the line of small boxes at the bottom of your scorecard to check off whether you have received federal funds as you pass the White House to keep track of this important factor. An "X" in a box signifies you qualified to receive funds, but an "O" in the box shows you received no funds. Four consecutive "O"s will terminate your campaign (See below).

The leader always receives $350,000, but any other player will receive $250,000 only if that player is in control of at least half of the total of electoral votes held by the leader. This calculation is made on the turn (at the very moment) that the candidate passes the White House, but before any consequences of that turn. EXAMPLE: If the vote leader has controlled states with 137 electoral votes then any other player must control 69 or more votes to collect campaign funds.

Towards the end of the campaign, a player may run low on finances. Therefore, at the beginning of a player's turn, and only at the beginning, that player may remove any campaign team from the board and be paid the cost for that campaign team—$200,000 from the treasury. If a player runs out or money during a turn, then that player must remove the campaign team from that player's state with the highest number of votes to obtain finds—being paid $200,000 from the treasury. Players may buy, sell, or trade states, which they control. But campaign workers in non-controlled states may not be bought, sold, or traded.

TERMINATING CAMPAIGNS: If you are not receiving federal funds, it probably means that your campaign is going nowhere. If you pass the White House four consecutive times without collecting funds (four consecutive "O"s in the series of boxes at the bottom of your score sheet), you must terminate your campaign. Complete the turn on which you passed the White House and then remove your candidate from the board and all offices and workers from the map. You have just "Thrown in the towel." Collecting $500,000 when you land on the White House allows you to put an "X" in the next open box in the line of boxes at the bottom of your score sheet and stop the string of consecutive "O"s.

Near the end of the game it is possible that all states (and the District of Columbia) become "controlled." At the moment that the last non-controlled state becomes controlled, the campaign of the player with the lowest electoral vote count is terminated. (Hint: If you are in that position, with lowest vote total, try a debate to free-up a state. Then they all won't be controlled and your campaign won't be terminated!)

FINAL THOUGHTS: Most of the campaign workers placed on the board by a player will be "free" workers obtained by that player or others landing on a state which that player controls through Campaign Headquarters cards, or by landing on the President Backs You space. It is important to remember that these campaign workers may be used anywhere such as either in debating or on any state not controlled by another player. Through these campaign workers a player need not continue to be "shut out" of a state.

Remember, a player is never out of the game until there is no money left and no campaign workers on the board to work for you. If that should happen, and tragically, we guess it can, the player's candidate is summarily removed from the board and play continues without that player.

To win, a player need not knock out all the opposing players, but merely be the first to accumulate 270 electoral votes. Due to the length of the game some may choose to play to a specified time limit. Whoever has the most votes at that time will win.

While the political campaign game has been shown and described in detail, it is obvious that this invention is not to be considered as limited to the exact form disclosed, and that changes in detail and construction may be made therein within the scope of the invention without departing from the spirit thereof.

I claim:

1. A political campaign game comprising:

a) a game board having a plurality of sides and defining a play surface;

b) said play surface including a map of the United States with first indicia disposed on the outline of each state indicating the number of electoral votes assigned to each said state, a plurality of spaces that forms a single common play path for the players that surrounds said map, a location for campaign headquarters, and a location for a campaign workers pool;

c) said play path including 50 state spaces and a plurality of non-state spaces, said state spaces each having second indicia disposed thereon indicating the name of each state and the number of electoral votes assigned to each said state;

d) a plurality of distinct play markers to be selected and used by each player to represent a respective player's candidate to be moved along said spaces in the play path, a plurality of campaign office devices that are associated with each distinct play marker and that correspond to campaign offices to be placed on states of the map during play, and a plurality of shaped campaign worker elements for placement on the campaign workers pool location and for removable attachment to each campaign office device wherein each said element represents a campaign worker during play;

e) a set of campaign headquarter cards for placement on the campaign headquarters location with each said card having instructions printed thereon, and each player has control of said campaign worker elements that each player places on the campaign workers pool location;

f) chance means for randomly determining the number of spaces a play marker may be moved along said play path during a player's turn; and g) play money for distribution to each player represented by a distinct candidate play marker on the space designated White House and one shaped campaign worker element disposed on said campaign workers pool location for beginning play.

2. A political campaign game as defined in claim 1 wherein said plurality of candidate play markers are of different selected colors to distinguish each player for moving its respective play marker to move along said spaces in said play path.

3. A political campaign game as defined in claim 2 wherein said plurality of campaign office devices are of said different selected colors corresponding to and associated with each distinct colored play marker.

4. A political campaign game as defined in claim 3 wherein said campaign office devices each has a base member with an upwardly directed spindle disposed thereon.

5. A political campaign game as defined in claim 2 wherein said plurality of shaped campaign worker elements are of said different selected colors corresponding to and associated with each distinct colored play marker.

6. A political campaign game as defined in claim 5 wherein said campaign office devices each has a base member with an upwardly directed spindle disposed thereon, and each said campaign worker element is star-shaped and has a bore that is effective to fit over each said spindle which extends upwardly for a distance sufficient to hold a plurality of said campaign worker elements of the same distinctive color as said same color play marker to represent campaign workers in a campaign office.

7. A political campaign game as defined in claim 6 wherein said spindle of each campaign office device extends upwardly from said base member for a distance sufficient to hold three said campaign worker elements to represent a complete campaign team that signifies control of a state on which a campaign office device rests during play.

8. A political campaign game as defined in claim 1 wherein said map includes five different colors each associated with a plurality of states.

9. A political campaign game as defined in claim 8 where said five different colors within a designated group of electoral votes include red for states having 21 to 55 electoral votes; blue states having 12 to 20 electoral votes; green states having 9 to 11 electoral votes; orange states having 5 to 8 electoral votes; and yellow states having 3 to 4 electoral votes.

10. A political campaign game as defined in claim 1 wherein said chance means includes a set of three standard dice each being a different color.

11. A political campaign game as defined in claim 1 including a set of five caution flags that are used to designate protected states and to accomplish the desired results of play.

12. A political campaign game as defined in claim 1 including a set of score sheets for each player to keep account of each player's electoral vote total during play.

13. A political campaign game as defined in claim 1 wherein said play path including at least 60 spaces for movement of each player's play markers; and said plurality of non-state spaces includes a first group of spaces containing indicia indicating that the president backs a player, a second group of spaces containing indicia indicating a player is to take orders from campaign headquarters, a space designated White House, a space designated Air Force 1, and a space designated Spin Zone.

14. A political campaign game as defined in claim 1 wherein said map of the United States includes five (5) groups of states designated by a different color as follows: CA, TX, NY, FL, PA, IL having 21 to 55 electoral votes; MA, VA, NJ, NC, GA, MI, OH having 12 to 20 electoral votes; LA, AL, CO, MD, AZ, WI, MN, IN, MO, TN, WA having 9 to 11 electoral votes; WV, NB, NM, UT, NV, MS, AR, KS, CT, IA, OK, OR, SC, KY having 5 to 10 electoral votes; and DE, DC, VT, AK, HI, ME, NH, RI, ID, MT, WY, ND, SD having 3 to 4 electoral votes.

15. A political campaign game as defined in claim 14 wherein said chance means includes a set of three standard dice, and before play starts, each player selects a home state by rolling all three (3) dice with the following rolls allowing the choice that will be the starting base for that player's campaign according to the following groups of states: a roll of 3 or 18—a home state selected from the 6 states having 21 to 55 electoral votes; a roll of 4 or 17—a home state selected from the 7 states having 12 to 20 electoral votes; a roll of 5 or 16—a home state selected from the 11 states having 9 to 11 electoral votes; a roll of 6, 7, 14, or 15—a home state selected from the 14 states having 5 to 8 electoral votes; and a roll of 8, 9, 10, 11, 12, or 13—a home state selected from the 13 states having 3 to 4 electoral votes.

16. A political campaign game as defined in claim 15 including a set of score sheets for each player to keep account of each player's electoral vote total during play; and upon choosing a home state, each player places thereon a campaign office device with a preselected number of campaign worker elements attached thereto to represent a complete campaign team and to signify control of that state while recording the number of electoral votes assigned to said home state on the player's score sheet.

17. A political campaign game as defined in claim 1 wherein said chance means includes a set of three (3) standard dice; and before play starts, each player selects a home state by rolling all three (3) dice to choose a home state on which the player places a campaign office device with a preselected number of removably attached campaign worker elements thereto to represent a complete campaign team and to signify control of the player's respective home state;

said campaign office devices with said preselected number of removably attached campaign worker elements being colored to correspond to each player's respective player marker for placement on the White House space to start play; and a campaign worker element representing each player for placement on the campaign workers pool location.

18. A political campaign game as defined in claim 1 wherein each player receives four (4) $50,000 amounts, three (3) $100,000 amounts, and one (1) $500,000 amount of said play money to equal a total of $1,000,000 to pay for opening campaign offices and for obtaining campaign workers in said offices during play; and each player receives $250,000 for each of the first two times a candidate passes the White House space during play, and a player having the most electoral votes at the time the player's candidate passes the White House space, that player will receive a bonus of $100,000 for a total of $350,000.

19. A political campaign game as defined in claim 1 wherein each time a player's respective play marker passes the White House space while moving clockwise along said play path, the player may place a campaign worker on the campaign workers pool location.

20. A political campaign game as defined in claim 1 wherein said campaign office devices each has a base member with an upwardly directed spindle disposed thereon and each player places a campaign office device with three (3) star-shaped campaign worker elements attached thereto to represent a complete campaign team of a campaign director, a campaign treasurer, and a media events coordinator placed in a home state to signify control of the respective player's home state;

as play continues, the first player to complete a team in any state by having a campaign office device disposed on a state of said map and said three (3) campaign worker elements immediately removes all of the other player's campaign teams in that state; and if a candidate lands on a state that is controlled by an opposing player, said candidate must pay $50,000 to the treasury and the player who controls the state gets the option to open a state campaign office by placing a campaign office device on any non-controlled state of said map, or by placing a campaign worker in an opened office by attaching a campaign worker element to a campaign office device disposed on any non-controlled state or the opposing player who controls the state may use a free campaign worker in a debate; and if a player's candidate play marker lands on a state controlled by that player, then that player has the option to do nothing, buy worker(s), or buy protection for the player's controlled state.

* * * * *